United States Patent [19]

Hsu

[11] Patent Number: 4,986,417

[45] Date of Patent: Jan. 22, 1991

[54] STRUCTURE OF STATIONERY CASE

[76] Inventor: Nick Hsu, 293 Per Tun Road, Taichung, Taiwan

[21] Appl. No.: 440,246

[22] Filed: Nov. 22, 1989

[51] Int. Cl.[5] ..... B65B 83/00

[52] U.S. Cl. ..... 206/214; 206/340; 206/818; 221/212

[58] Field of Search ..... 206/340, 818, 214; 221/212

[56] References Cited

U.S. PATENT DOCUMENTS

| | | | |
|---|---|---|---|
| 531,384 | 12/1894 | Olson | 221/212 |
| 2,848,006 | 8/1958 | Simpson | 206/818 X |
| 3,731,415 | 5/1973 | Shore | 206/818 X |
| 3,743,082 | 7/1973 | Hermann | 206/818 X |
| 3,750,868 | 8/1973 | Cooper | 206/818 X |
| 3,961,721 | 6/1976 | Gordon et al. | 206/818 X |
| 4,058,209 | 11/1977 | Schmidt | 206/818 X |

FOREIGN PATENT DOCUMENTS

| | | | |
|---|---|---|---|
| 286675 | 7/1928 | United Kingdom | 206/818 |

*Primary Examiner*—Paul T. Sewell
*Assistant Examiner*—Jacob K. Ackun, Jr.

[57] ABSTRACT

A stationery case has therein an actuating lever controlled by a pivoted cover to make reciprocating motion so that the magnet which is attached to the actuating lever at its front bottom end can attract some pieces of the metal materials, which are received in the case, for convenient handling.

3 Claims, 4 Drawing Sheets

STRUCTURE OF STATIONERY CASE

BACKGROUND OF THE INVENTION

Following technology development, any commercial product which is more practical and convenient in use would be more acceptable to consumers, and which is made through innovative design would be more attractive to induce people to buy. For example, for arrangement of stationery accessories, such as clips, thumb tacks, . . . etc., consumers may require a device to contain such stationery accessories so that they can be conveniently picked up for use. For handling paper documents, various stationery accessories may be used to clip, clamp or hold papers so as to keep them firmly in place. Regular writing materials are normally made of metal material. When a variety of stationery accessories are put together in a container, they may be in disorder. Thus, one may take a lot of time to pick up a specific one from the disorderly stationery accessories in such a container, and one may be easily hurt by the sharp-pointed ends of the stationery accesssories therein during handling. This is a kind of stationery case for receiving writing materials, which is generally comprised of a casing having a round hole on its top with a circular magnetic iron internally made around such a round hole. When in use, the top round hole of the stationery case shall be blocked up with one hand and then the case is turned upside-down permitting some pieces of stationery accessories which are received in such a stationery case to be attracted by the magnetic iron for handling. This invention is related to an improvement made on the above-mentioned stationery case which utilizes magnetic force to attract metal materials therein.

It is therefore, an object of the present invention to provide such a stationery case which utilizes its movable cover to carry an actuating lever to make reciprocating motion so as to automatically pick up the metal materials received therein by means of a magnet mounted on the front bottom end of such an actuating lever.

SUMMARY OF THE INVENTION

A stationery case of the present invention is generally comprised of a pivoted cover which is made in geometric figure defining a turning space with its one side and comprises a pair of lugs having thereon a pair of holes; an elongated actuating lever which has a magnet attached thereto at its front end and comprises an arch-shaped retaining portion at its upper rear end and a stop portion at its lower rear end; and a container which has a notch on its top at the side corresponding to said turning space, two opposite pivot pins for insertion into said two holes of said two lugs. The pivoted cover is pivoted to the container with the actuating lever squeezed in therebetween permitting the actuating lever to make reciprocating motion in the container by means of leverage through the operation its retaining portion and stop portion during pivot motion of the pivoted cover relative to the container so as to attract metal materials received therein through its magnet for convenient handling.

Embodiments of the present invention will be described by way of example, with reference made to the annexed drawings in which:

DETAILED DESCRIPTION OF THE PREFERRED EMBODIMENT

Figure 1:
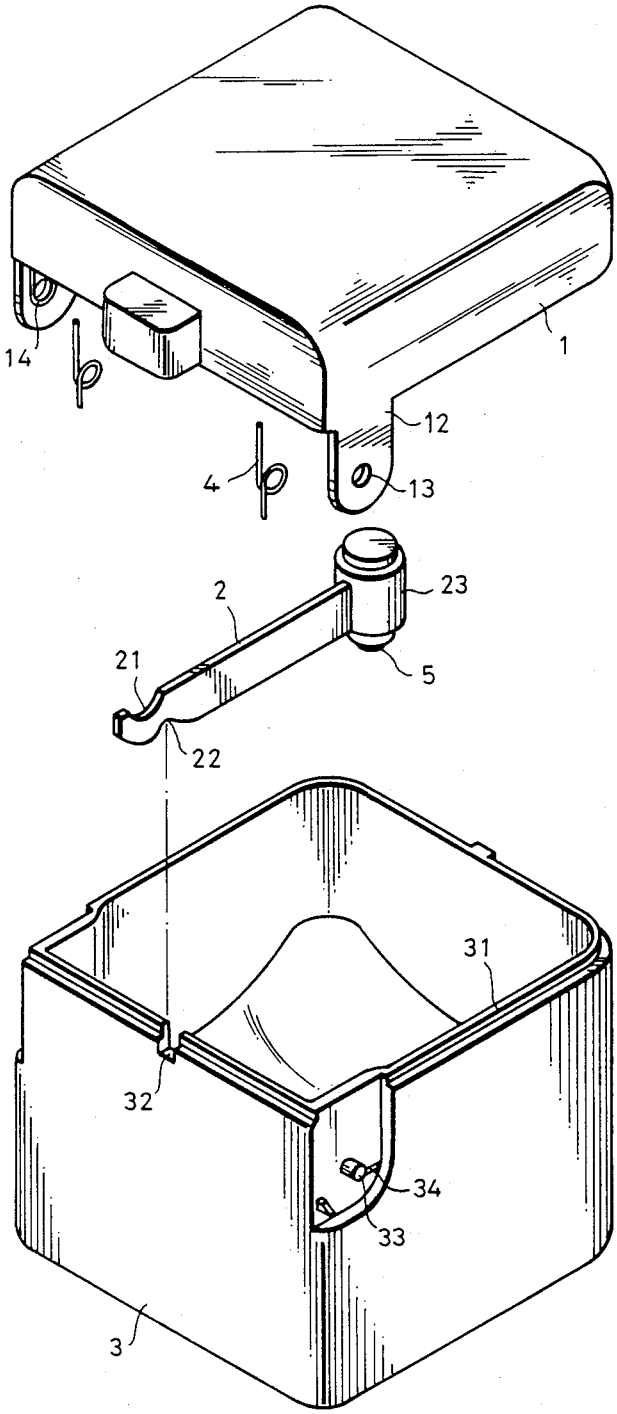
FIG. 1 is a perspective fragmentary view of the present invention.

Turning now to the attached drawings in greater detail and first referring to FIG. 1, therein illustrated is a stationery case embodying the present invention and generally comprised of a pivoted cover (1), an actuating lever (2), a container (3), and one pair of torsion springs (4).

The container (3) is unitarily made through shape molding process in geometric figure, defining therein a curved inner bottom surface An unitary setback flange (31) is upstanding from the sidewall portion of the container (3). A notch (32) is made on the top flange (31) at its one side in the middle for securing thereto of the actuating lever (2). Two unitary pivot pins (33) are made on the container (3) at two lateral sides relative to the notch (32).

The actuating lever (2) is made through shape molding process in a L-shaped configuration, comprising an unitary arch-shaped retaining portion (21) at its upper rear end, a stop portion (22) at its lower near end opposite to such a retaining portion (21), which stop portion (22) is seated in the notch (32) of the container (3) during assembly, and a front vertical rod (23) having attached thereto a magnet (5) at its bottom.

The pivoted cover (1) is made in size corresponding to the container so that it can be pivoted to the container (3) to cover the flange (31) of the container. Two opposite lugs (12) are downwardly extending from the pivoted cover (1) at both lateral sides thereof, to define therebetween a turning space (11) corresponding to the notch (32) of the container (3). Two holes (13) are made on the two opposite lugs (12) for insertion therein of the two pivot pins (33) of the container (3) during assembly. A recess each (14) or (34) is made on each lug (12) by each hole (13) as well as on the container (3) by each pivot pin (33), so that a torsion spring (4) each can be mounted on each pivot pin (33) with its both ends respectively seated in corresponding recesses (14) and (34).

Figure 2A:
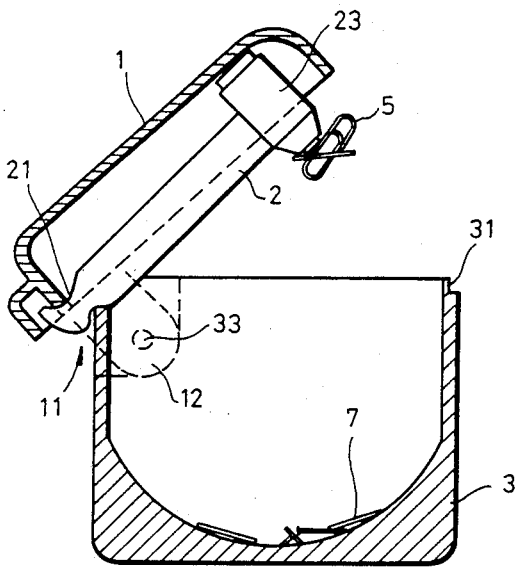
FIGS. 2A and 2B are schematic drawings, illustrating the operation of the present invention.
Figure 2B:
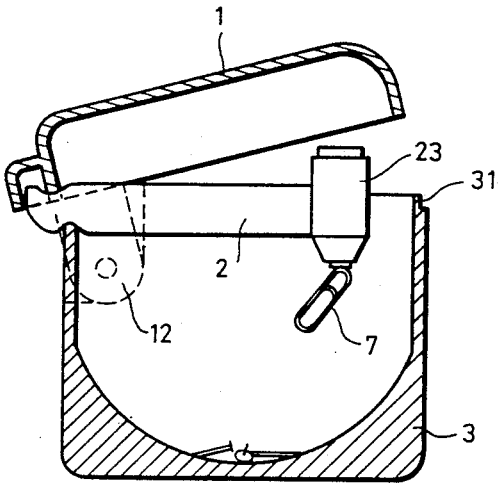
Figure 2C:
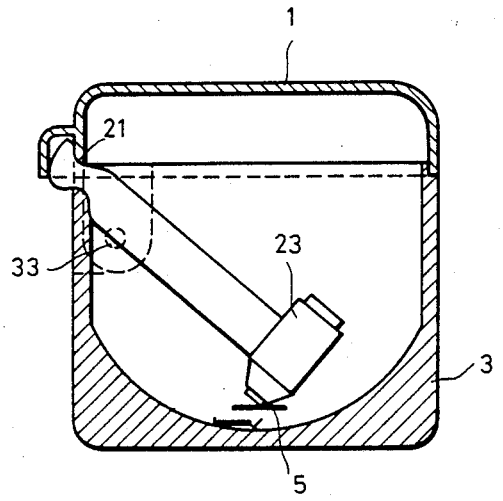

FIGS. 2A and 2B are schematic drawings illustrating the operation of the present invention. As illustrated in FIG. 2, through the guiding of the two holes (13) of the two lugs (12) of the pivoted cover (1) and the effect of the two torsion springs (4), the pivoted cover (1) is constantly lifted to an upper position. Under this condition, the turning space (11) is obliquely displaced downward, and the retaining portion (21) of the actuating lever (2) is simultaneously forced to incline downward backward. Through the effect of the stop portion (22), the actuating lever (2) is simultaneously forced to lift by means of leverage, permitting its front vertical rod (23) to be stopped by the inner bottom surface of the pivoted cover (1). During lift stroke of the actuating lever (2), the magnet (5) of its front vertical rod (23) attracts some pieces of stationery accessories (clips or pins, etc.) for convenient handling. When the pivoted cover (1) is pressed downward, as illustrated in FIG. 2B, the retaining portion (21) of the actuating lever (2) is displaced in the turning space (11) permit ting the actuating lever (2) to be horizontally disposed in parallel with the top edge of the container (3). As soon as the pivoted cover (1) is completely closed up with the container (3), the turning space (11) is displaced accordingly, and the torque is changed according to the position change of the retaining portion (21). Therefore, the actuating lever (2) is permitted to rotate in the container (3).

I claim:

1. A stationery case comprising a pivotable cover having a pair of lugs connected to said cover and extending at right angles to a top of said cover, each of said lugs having a hole through the lug, said lugs defining between them a rotation facilitating space, a container comprising a bottom and side walls extending upwardly therefrom for engagement with said cover, a side wall of said container in vertical alignment with said rotation facilitating space having a notch at an upper edge thereof, two side walls of said container in vertical alignment with said lugs, each having a pivot pin attached thereto for insertion into the holes of the lugs, an elongated actuating lever having a magnet attached thereto at a front end thereof, said actuating lever further comprising an arch-shaped retaining portion at an upper rear end and a stop portion at a lower rear end, and wherein said cover is pivotably attached to said container by means of the pivot pins fitting into the holes in said lugs, said rear end of said actuating lever being secured between said cover and said container in a region of said notch, such that said actuating lever is pivoted when said cover is pivoted about said container, the magnet therefore being rotatable from a position at the container bottom when said cover is closed to a position above the container sidewalls when said cover is open, and vice versa, said magnet and actuating lever being adapted to present metallic objects normally disposed on the container bottom at an easily accessible position at the top of said container, upon opening of the cover.

2. A stationery case according to claim 1, further comprising a pair of torsion springs each mounted on one of a pair of said lugs and pivot pins, to provide a spring force tending to keep said cover open.

3. A stationery case according to claim 1, wherein said container bottom on the inside of said container has a curved surface.

* * * * *